US006826794B2

(12) United States Patent
Mahoney et al.

(10) Patent No.: US 6,826,794 B2
(45) Date of Patent: Dec. 7, 2004

(54) APPARATUS AND METHOD FOR POSITIONING A PATIENT DURING SURGERY

(75) Inventors: Ormonde Martin Mahoney, Athens, GA (US); Donald Edward Templeman, Jr., Athens, GA (US); Jack Dean Deweese, Jr., Duluth, GA (US)

(73) Assignee: Surgical Devices, Inc., Athens, GA (US)

( * ) Notice: Subject to any disclaimer, the term of this patent is extended or adjusted under 35 U.S.C. 154(b) by 0 days.

(21) Appl. No.: 10/342,375

(22) Filed: Jan. 14, 2003

(65) Prior Publication Data

US 2004/0133984 A1 Jul. 15, 2004

(51) Int. Cl.[7] ..... A61G 13/12
(52) U.S. Cl. ..... 5/624; 5/621; 5/648; 5/651
(58) Field of Search ..... 5/612, 621–623, 5/662, 624, 648, 651, 650; 128/882; 606/87, 88

(56) References Cited

U.S. PATENT DOCUMENTS

| | | | | |
|---|---|---|---|---|
| 3,261,034 A | * | 7/1966 | Bradley | 5/658 |
| 3,990,122 A | * | 11/1976 | Peterson | 5/651 |
| 4,240,170 A | * | 12/1980 | Thumberger et al. | 5/651 |
| 4,428,571 A | | 1/1984 | Sugarman | |
| 5,645,079 A | | 7/1997 | Zahiri et al. | |
| 5,740,571 A | * | 4/1998 | Tyra | 5/624 |
| 5,775,334 A | | 7/1998 | Lamb et al. | |
| 5,926,876 A | | 7/1999 | Haigh et al. | |
| 6,295,671 B1 | | 10/2001 | Reesby et al. | |
| 6,375,355 B1 | * | 4/2002 | Fortin | 378/209 |
| 6,378,149 B1 | | 4/2002 | Sanders et al. | |
| 6,446,287 B2 | | 9/2002 | Borders | |

FOREIGN PATENT DOCUMENTS

| | | |
|---|---|---|
| DE | 43 00 369 A | 7/1994 |
| FR | 2 631 231 A | 11/1989 |
| FR | 2 732 213 A | 10/1996 |

* cited by examiner

*Primary Examiner*—Michael Trettel
(74) *Attorney, Agent, or Firm*—Dinsmore & Shobl LLP

(57) ABSTRACT

A patient positioning device and method of operation that is simple in construction, is easy to install, is positioned outside the sterile operating field, yet permits the surgeon to readily position, adjust, and re-position a patient during a surgical procedure is provided and includes a support adapted to be positioned against a predetermined portion of a patient's body, a drive mechanism for moving the support along a generally linear path, a source of power for the drive mechanism, a bracket for mounting the drive mechanism to an operating table, and a remote device for actuating the drive mechanism.

21 Claims, 3 Drawing Sheets

APPARATUS AND METHOD FOR POSITIONING A PATIENT DURING SURGERY

BACKGROUND OF THE INVENTION

The present invention relates to the field of surgery, and more particularly to a device and method that are used to position a patient during a surgical procedure.

During various orthopedic surgical procedures, there is a need to properly position a patient, including a limb, for the procedure. Some procedures require that the patient or patient's limb be re-positioned during different parts of the procedure. One method of positioning patients during surgical procedures has been the use of an assistant surgeon or other trained personnel to manually hold, maneuver, and maintain a patient in a desired position. However, this method has several disadvantages including the costs involved with using additional operating room personnel and the fact that it is difficult for a person to hold and maintain a desired position for the length of time required for the procedure to be performed.

Currently, there are several devices that are available to surgeons that aid in properly positioning a patient for surgery. However, many of these devices are fixed devices in the sense that they are positioned, secured, or mounted manually on an operating table prior to the start of the surgical procedure. Once the procedure begins, such devices cannot be easily moved, adjusted, or re-positioned. Thus, if a surgical procedure requires that the patient be re-positioned during different parts of the procedure, the surgery must be temporarily halted while the patient positioning device is moved or hand-adjusted, typically through the use of thumbscrews, levers, sliding bars, and the like.

Mechanically, electrically, or hydraulically-driven devices have also been suggested. For example, Zahiri et al, U.S. Pat. No. 5,645,079, teach an apparatus for holding, maneuvering, and maintaining a body part of a patient during surgery. One embodiment of the device physically straps the upper leg and foot of a patient to supports that are movable using motor driven gears that provide lateral, tilting, and swinging movement. However, such a device is mechanically complex and requires sterilization of portions of the device that are located in the sterile operating field. Further, once the patient is strapped into the device, manual positioning of the leg is not possible.

Accordingly, the need still exists in the art for a patient positioning device and method that are simple in construction, easy to install and position, and that can be used outside the sterile operating field.

SUMMARY OF THE INVENTION

The present invention addresses those needs by providing a patient positioning device and method of operation that is simple in construction, is easy to install, is positioned outside the sterile operating field, yet permits the surgeon to readily position, adjust, and re-position a patient during a surgical procedure.

In accordance with one aspect of the present invention, a patient positioning device is provided and includes a support adapted to be positioned against a predetermined portion of a patient's body; a drive mechanism for moving the support along a generally linear path; a source of power for the drive mechanism; a bracket for mounting the drive mechanism to an operating table; and a remote device for actuating the drive mechanism.

In a preferred form, the support is padded to provide additional comfort for a patient. In one embodiment, the support is generally cylindrical in shape. The support may be adapted to be positioned against any predetermined portion of a patient's body. In one embodiment of the invention, the support is designed to be positioned against the foot of a patient.

The drive mechanism may comprise a number of electrically, hydraulically, or pneumatically operated devices. In one embodiment of the invention, the drive mechanism comprises a linear actuator. In a preferred form, the support includes an extension, preferably angled, and the drive mechanism is coupled to the extension. Preferably, the extension includes means for adjusting the height of the support. In one embodiment of the invention, the means include a plurality of generally spaced openings on the extension and a pin for releasably locking the extension in a predetermined position through such spaced openings.

The device of the present invention provides convenience for the surgeon by permitting remote operation of the drive mechanism. In a preferred embodiment, the remote device comprises a foot-operated switch. The present invention also provides a method for positioning a patient during a surgical procedure comprising positioning a patient on an operating table; positioning a movable support against a predetermined portion of a patient's body outside of the sterile operating field; causing the support to move by actuating a drive mechanism to provide linear movement of the support to cause the patient to move to an optimal position for a surgical procedure.

In a preferred embodiment, the movable support is positioned against the patient's foot. Movement of the support causes flexing of the patient's knee to an optimal position for a surgical procedure. Depending on the surgical procedure to be performed, the support may be moved to a second position during the surgical procedure. Additional movement of the support during surgery is possible, depending upon the need for re-positioning of the patient.

Accordingly, it is a feature of the present invention to provide a patient positioning device and method of operation that is simple in construction, is easy to install, is positioned outside the sterile operating field, yet permits the surgeon to readily position, adjust, and re-position a patient during a surgical procedure. These and other features and advantages of the invention will become apparent from the following detailed description, the accompanying drawings, and the appended claims.

BRIEF DESCRIPTION OF THE DRAWINGS

For ease of understanding, reference will now be made by way of example to the drawings in which like reference numerals represent like elements and in which.

DETAILED DESCRIPTION OF THE PREFERRED EMBODIMENT

It will be understood that the present invention is not limited to the specific embodiments shown. The device and method are applicable to positioning a patient for a number of surgical procedures including, but not limited to, total hip replacement, lumber surgery, open reduction internal fixation of the elbow, open reduction internal fixation of the femur, foot fusion, posterior cruciate ligament reconstruction, shoulder repairs, total shoulder replacement, spinal fusion, open reduction internal fixation of the tibia, anterior cervical discectomy and fusion of the neck, arthroscopic anterior cruciate ligament reconstruction, arthroscopic knee evaluation, and partial and total knee replacement. It will also be understood that the construction of the support may be modified to accommodate specific body parts depending upon the surgical procedure being performed. While the following detailed description is made with respect to positioning a patient's knee for a surgical procedure, it will be understood that the invention encompasses other surgical procedures and that the following description is made with reference to a preferred embodiment thereof and to simplify understanding of the invention.

Figure 1:
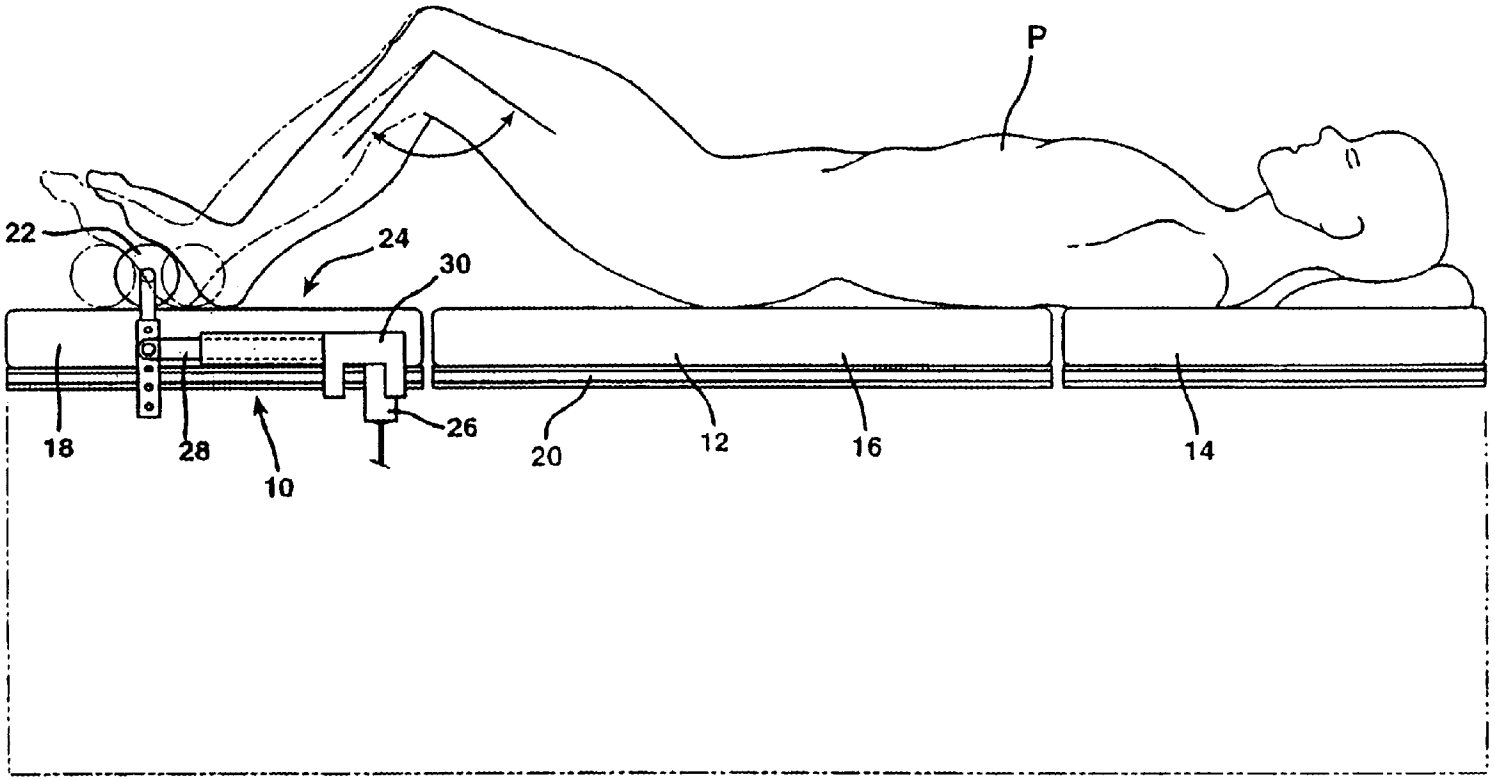
FIG. 1 illustrates in a side elevational view one embodiment of the invention in which a patient is positioned on an operating table with a support against one foot for positioning the knee of that patient for a surgical procedure.

With reference to FIG. 1, the apparatus for positioning a patient P on an operating table 12 is generally indicated at 10. Current commercially-available operating tables typically may be segmented and include a head and upper body support section 14, a trunk support section 16, and a leg support section 18. Operating table 10 also includes a pair of stand-off rails running substantially the length of the operating table. Rail 20 is shown, and a complementary rail is hidden on the opposite side of the table.

Device 10 includes a support 22 that is adapted to be positioned against a predetermined portion of a patient's body. As shown in FIG. 1, support 22 is positioned beneath the patient's foot. Device 10 also includes a drive mechanism 24 for moving support 22 along a generally linear path. Drive mechanism 24 may be electrically, hydraulically, or pneumatically powered.

Figure 2:
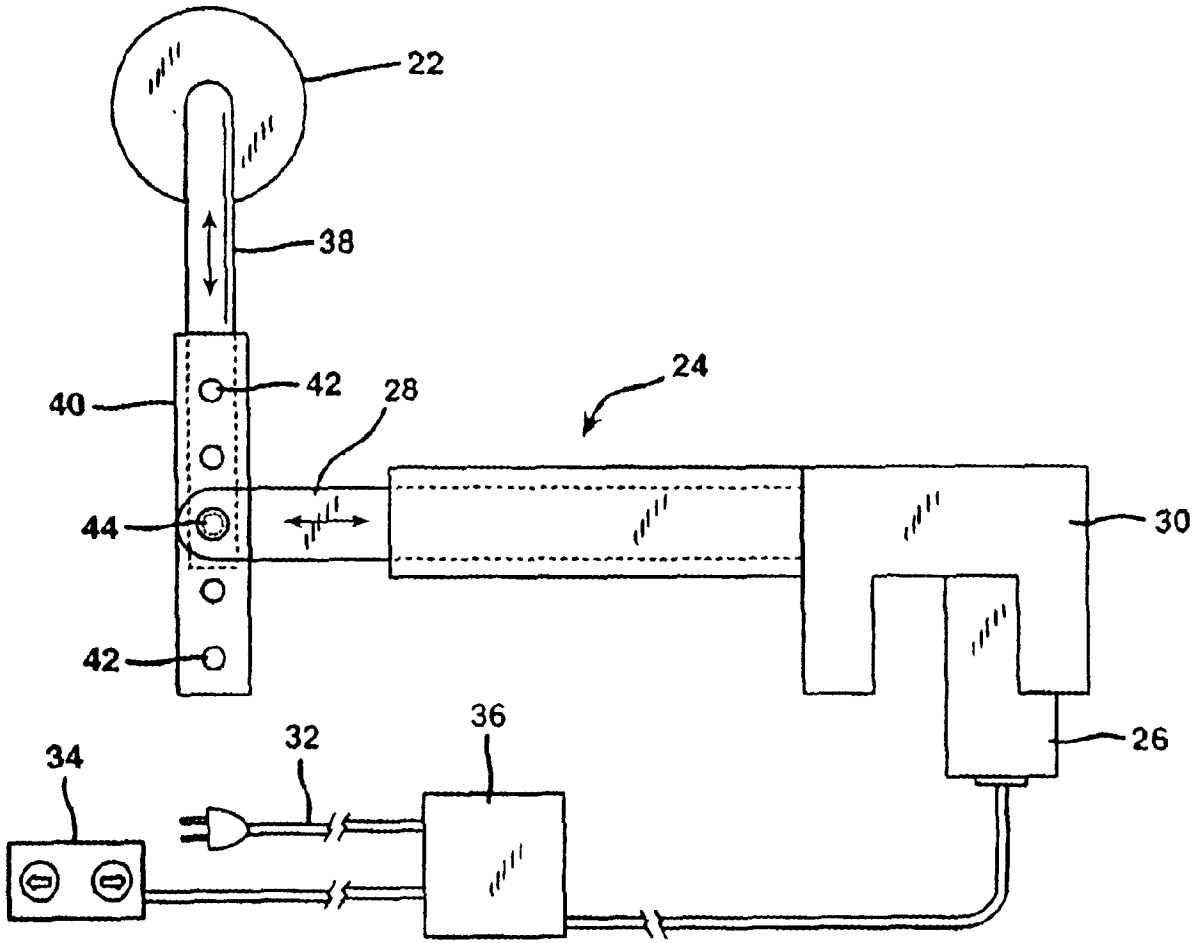
FIG. 2 schematically illustrates a side view of the support and drive mechanism of one embodiment of the invention.
Figure 3:
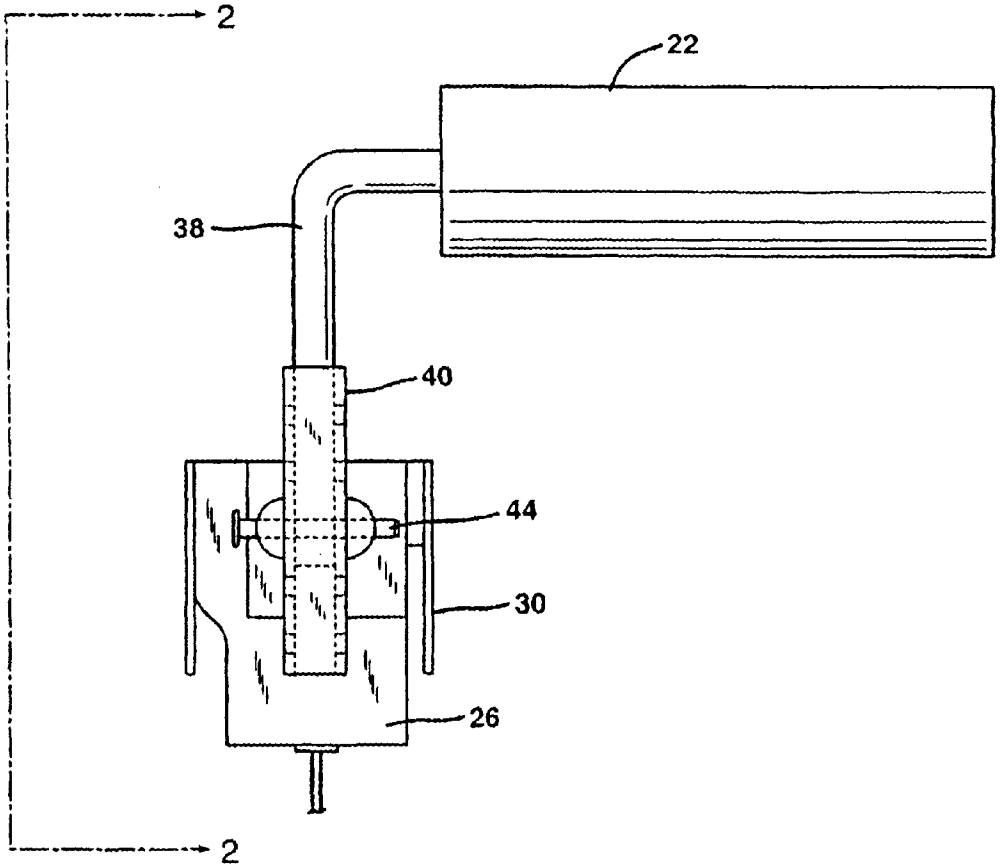
FIG. 3 is an end view of the support and drive mechanism of FIG. 2.

As shown in greater detail in FIGS. 2 and 3, and in the preferred embodiment shown, drive mechanism 24 comprises an electrically powered linear actuator. The actuator includes a motor 26, worm gearing and a lead screw (not shown), and a thrust tube 28. Power to motor 26 causes rotation of the worm screw drive resulting in thrust tube 28 either extending or retracting. The linear actuator may be a commercially available device such as linear drives from Magnetic Corporation of Olney, Ill. a subsidiary of SKF Linear Motion.

Bracket 30 is used to secure drive mechanism 24 to support rail 20. Thumbscrews, clamps, or other attachment devices may be used. The bracket and attachments are designed so that the drive mechanism 24 is readily moveable from one side of an operating table to an opposite side or end, depending upon the particular surgical procedure to be performed.

Referring again to FIG. 2, drive mechanism 24 is driven by an electric motor 26. A source of power for the drive mechanism is provided through electrical plug 32. The surgeon using a foot-operated switch 34 remotely actuates the drive mechanism. Depending on the motion desired, the surgeon can cause the thrust tube 28 to move as shown in FIG. 1 by pressing on the corresponding end of the switch. Activation of switch 34 causes controller 36 to drive motor 26 in a desired direction.

Referring now to FIG. 3, support 22 may be padded for patient comfort. In the embodiment shown, support 22 is in the form of a cylinder. However, it will be understood that support 22 may take different forms as required by the surgical procedure selected. Support 22 includes an angled extension 38 that either fits into or becomes a sleeve 40. Sleeve 40 includes a plurality of spaced openings 42 that extend through the sleeve. In the embodiment shown, the height of support 22 is vertically adjustable by aligning different holes in the sleeve with a complementary opening at the end of thrust tube 28 and securing the thrust tube and sleeve with a lynch pin 44. It will be apparent that other height adjustable securing mechanisms may be used in place of the lynch pin and openings.

In use, a patient is positioned on operating table 12 and device 10 is installed so that movable support 22 is properly positioned against a predetermined portion of the patient's body. As shown, support 22 is positioned beneath the foot of the patient. As can be seen, the device 10 of the present invention can be positioned and used outside of the sterile operating field and does not interfere with a surgeon's and/or other surgical assistant's movements. The surgeon presses foot-operated switch 34 to cause support 22 to move the patient's leg into a proper and optimal position for the procedure. As shown in FIG. 1, movement of support 22 changes the angle of the patient's knee.

In some surgical procedures, it is necessary to move a patient's limb or body to a first position for initial work and then to move that limb or body portion to second, third or more optimal positions as the surgery proceeds. The surgeon remotely activating the drive mechanism easily accomplishes re-positioning.

While certain representative embodiments and details have been shown for purposes of illustrating the invention, it will be apparent to those skilled in the art that various changes in the methods and apparatus disclosed herein may be made without departing from the scope of the invention.

What is claimed is:

1. Apparatus for positioning a patient during a surgical procedure comprising: a support adapted to be positioned against a predetermined portion of a patient's body, said support including an extension and said extension including means for adjusting the height of said support; a drive mechanism for moving said support along a generally linear path; a source of power for said drive mechanism; a bracket for mounting said drive mechanism to an operating table; and a remote device for actuating said drive mechanism.

2. An apparatus as claimed in claim 1 wherein said support is padded.

3. An apparatus as claimed in claim 1 wherein said support is generally cylindrical in shape.

4. An apparatus as claimed in claim 1 wherein said support is adapted to be positioned against the foot of a patient.

5. An apparatus as claimed in claim 1 wherein said drive mechanism comprises a linear actuator.

6. An apparatus as claimed in claim 1 wherein said extension is angled.

7. An apparatus as claimed in claim 1 wherein said drive mechanism is coupled to said extension.

8. An apparatus as claimed in claim 7 wherein said extension includes a plurality of generally spaced openings.

9. An apparatus as claimed in claim 1 further including a pin for releasably locking said extension in a predetermined position.

10. An apparatus as claimed in claim 1 wherein said source of power is electrical.

11. Apparatus for positioning a patient during a surgical procedure comprising: a support adapted to be positioned against a predetermined portion of a patient's body; a drive mechanism for moving said support along a generally linear path; a source of power for said drive mechanism; a bracket for mounting said drive mechanism to an operating table; and a remote device for actuating said drive mechanism, said remote device comprising a foot-operated switch.

12. Apparatus for positioning a patient during a surgical procedure comprising: a padded support adapted to be positioned against a foot of a patient's body, said support including an angled extension, said extension including means for adjusting the height of said support; a drive mechanism coupled to said extension for moving said support along a generally linear path; a source of electrical power for said drive mechanism; a bracket for mounting said drive mechanism to an operating table; and a remote device for actuating said drive mechanism.

13. An apparatus as claimed in claim 12 wherein said extension includes a plurality of generally spaced openings.

14. An apparatus as claimed in claim 12 further including a pin for releasably locking said extension in a predetermined position.

15. A method of positioning a patient during a surgical procedure comprising: positioning a patient on an operating table; positioning a movable support against a predetermined portion of a patient's body outside of the sterile operating field; causing said support to move by actuating a drive mechanism to provide linear movement of said support to cause said patient to move to an optimal position for a surgical procedure.

16. A method as claimed in claim 14 which said movable support is positioned against said patient's foot.

17. A method as claimed in claim 15 in which movement of said support causes flexing of said patient's knee to an optimal position for a surgical procedure.

18. A method as claimed in claim 14 in which said support is moved to a second position during said surgical procedure.

19. Apparatus for positioning a patient during a surgical procedure comprising: an operating table, said operating table including at least one stand off rail along the length of a side of said operating table; a support adapted to be positioned against a predetermined portion of a patient's body; a drive mechanism for moving said support along a generally linear path; a source of power for said drive mechanism; a bracket for mounting said drive mechanism to said stand off rail of said operating table; and a remote device for actuating said drive mechanism.

20. An apparatus as claimed in claim 19, wherein said support includes an extension and said extension includes means for adjusting the height of said support.

21. An apparatus as claimed in claim 19 wherein said remote device comprises a foot-operated switch.

* * * * *